US006644577B2

(12) United States Patent
Togashi et al.

(10) Patent No.: US 6,644,577 B2
(45) Date of Patent: Nov. 11, 2003

(54) JAW CRUSHER

(75) Inventors: Ryoichi Togashi, Hirakata (JP); Mitsunobu Yamada, Iruma (JP)

(73) Assignee: Komatsu, Ltd., Tokyo (JP)

( * ) Notice: Subject to any disclaimer, the term of this patent is extended or adjusted under 35 U.S.C. 154(b) by 16 days.

(21) Appl. No.: 10/197,535

(22) Filed: Jul. 18, 2002

(65) Prior Publication Data

US 2003/0034412 A1 Feb. 20, 2003

(30) Foreign Application Priority Data

Aug. 16, 2001 (JP) ..... 2001-246894

(51) Int. Cl.[7] ..... B02C 1/04
(52) U.S. Cl. ..... 241/264; 241/267
(58) Field of Search ..... 241/264, 267, 241/283, 262

(56) References Cited

U.S. PATENT DOCUMENTS 4,361,289 A * 11/1982 Georget et al. ..... 241/32
4,679,742 A * 7/1987 Ellis ..... 241/266
6,116,530 A * 9/2000 Altmayer et al. ..... 241/264
6,375,105 B1 * 4/2002 Haven et al. ..... 241/264

FOREIGN PATENT DOCUMENTS

| | | |
|---|---|---|
| DE | 44 00 922 A1 | 3/1995 |
| FR | 1151290 | 1/1958 |
| JP | 5-45300 | 7/1993 |
| JP | 10-249224 | 9/1998 |
| WO | WO 02/34393 | 5/2002 |

* cited by examiner

*Primary Examiner*—John M. Husar
(74) *Attorney, Agent, or Firm*—Rader, Fishman & Grauer PLLC; Ronald P. Kananen

(57) ABSTRACT

A compact and light-weight jaw crusher, in which life span of parts enduring abrasion is long, and an outlet clearance of a crushing chamber is easily adjusted, is provided. For this purpose, the jaw crusher includes a stationary jaw (3) fixedly provided at a frame (2), a movable jaw (5) which is provided to oppose the stationary jaw and attached swingably with an eccentric drive shaft (4), a movable jaw load receiving section (10) attached to the frame, and a coupling joint (23) which is a connecting member for connecting a lower portion of the movable jaw and the movable jaw load receiving section and swingably connects the lower portion of the movable jaw and the movable jaw load receiving section.

7 Claims, 9 Drawing Sheets

JAW CRUSHER

TECHNICAL FIELD

The present invention relates to a jaw crusher, and particularly to a movable jaw holding mechanism, and an adjusting mechanism for a tip clearance between a movable jaw and a stationary jaw.

BACKGROUND ART

Various proposals have been conventionally made for the structure of a jaw crusher, and as examples thereof, those disclosed in Japanese Patent Application Publication No. 5-45300 and Japanese Patent Application Laid-open No. 10-249224, are cited.

FIG. 8 is an explanatory view in a side section of a crusher disclosed in Japanese Patent Application Publication No. 5-45300. Inside a crusher main body 60, a swing jaw 61, having a movable jaw 5, is suspended from an eccentric shaft 62, and a stationary jaw 3 is attached to oppose it. A lower end portion of a toggle block 63 is rotatably attached to the crusher main body 60 with a pin 64. A base end portion of a hydraulic actuator 70 having a frictional force utilizing close fit of a sleeve and a cylinder rod is swingably attached to the crusher main body 60, and its tip end portion is rotatably attached at an upper end portion of the toggle block 63 with a pin 65.

An adjusting hydraulic cylinder 71 is provided in series at a rear end portion of the hydraulic actuator 70. Toggle sheets 66 and 66 each having a groove portion are provided at a lower end portion of the swing jaw 61 and at a center portion of the toggle block 63, and a toggle plate 67 is inserted between the groove portions of both the sheets 66 and 66 with both end portions being slidable. A spring 68 is biased so that the swing jaw 61 and the toggle block 63 always hold the toggle plate 67 between them.

Hydraulic pressure of the adjusting hydraulic cylinder 71 is adjusted at a predetermined set pressure during a crushing operation so that the cylinder rod of the hydraulic actuator 70 is held at an arbitrary position by a frictional force of the sleeve and the cylinder rod, and a clearance between tip end portions of the movable jaw 5 and the stationary jaw 3 is maintained.

FIG. 9 is an explanatory view of a sectional side view of a jaw crusher disclosed in Japanese Patent Application Laid-open No. 10-249224. A swing jaw 61 having the movable jaw 5 is swingably suspended at an eccentric shaft 62 attached at upper portions of left and right side frames 80 and 80, and the stationary jaw 3 is fixedly provided at the side frame 80 to oppose it to form a crushing chamber 6. A toggle block 63 is attached to the side frame 80 by a block support shaft 81 with its base end portion being rotatable. A window 82 having a semicircular portion is provided near a tip end portion of the toggle block 63 at the side frame 80, a semicircular disc-shaped load supporting plate 83 is fitted in the window 82, and a set adjusting plate 84 for adjusting an outlet clearance of the crushing chamber 6 is provided between the load supporting plate 83 and the toggle block 63.

Toggle sheets 66 and 66 each having a groove portion are attached to a lower end portion of the swing jaw 61 and the toggle block 63. A toggle plate 67 is provided between groove portions of both the sheets 66 and 66 so that both ends thereof are slidable, and the lower end portion of the swing jaw 61 is always biased to the toggle block 63 by a spring 85. The toggle block 63 and the side frame 80 are connected by a bare rock type of hydraulic cylinder 86, the toggle block 63 is rotated by a hydraulic cylinder 86 at the time of adjusting the outlet clearance of the crushing chamber 6, and a clearance is provided between the toggle block 63 and the load supporting plate 83 so that the thickness of the set adjusting plate 84 is adjusted.

However, the above-described structures have the following disadvantages.

In the structure disclosed in Japanese Patent Application Publication No. 5-45300, the toggle sheets 66 and 66 are attached to the lower end portion of the swing jaw 61 and the toggle block 63, and the toggle plate 67 is held between both the sheets 66 and 66 to receive a load during crushing. Accordingly, the toggle plate 67 is sandwiched, and the spring 68 is used to hold it, which makes the structures complicated and requires adjustment of the spring 68 each time the tip clearance is adjusted, thus increasing adjustment time. In addition, when they are mounted on vehicles, operating spaces become narrow, which makes adjusting operations themselves difficult.

Since the adjusting hydraulic cylinder 71 is provided at the rear end portion of the hydraulic actuator 70, the total length of the hydraulic cylinder part is long, and since it is horizontally arranged, a total length N of the jaw crusher 61 shown in FIG. 8 is long, which makes a space area large to cause the disadvantage when mounted on a vehicle and the like. Since pressure is always applied to the adjusting hydraulic cylinder 71, energy is wasted. Further, oil leakage occurs, which makes it unstable. A complicated hydraulic circuit structure is necessary to prevent the oil leakage, which makes it expensive.

In the structure disclosed in Japanese Patent Application Laid-open No. 10-249224, as in the structure described above, the toggle plate 67 is sandwiched, and the spring 85 is used to hold it, which makes the structures complicated and requires adjustment of the spring 85 each time the tip clearance is adjusted, thus increasing adjustment time. In addition, when they are mounted on vehicles, operating spaces become narrow, which makes adjusting operations themselves difficult. Further, it adopts the method of preventing breakage of the other components by the toggle plate 67 being bent under excessive load, and a replacement operation of the bent toggle plate 67 is difficult, thus requiring a great deal of time. Furthermore, since adjustment of the outlet clearance of the crushing chamber 6 is made with the set adjustment plate 84, a great deal of time is required for adjustments and thus operation efficiency is low.

SUMMARY OF THE INVENTION

The present invention is made in view of the above-described disadvantages, and has its object to provide a compact and light-weight jaw crusher in which life span of parts enduring abrasion is long, a structure is simple, less part is damaged under excessive load with excellent operation efficiency, greater economy is obtained with no energy loss, and an outlet clearance of a crushing chamber is easily adjusted.

In order to attain the above-described object, a first aspect of the jaw crusher according to the present invention is a jaw crusher has the structure including a stationary jaw fixedly provided at a frame, a movable jaw which is provided to oppose the stationary jaw and attached swingably with an eccentric drive shaft, a movable jaw load receiving section attached to the frame, and a coupling joint which is a connecting member for connecting a lower portion of the movable jaw and the movable jaw load receiving section and swingably connects the lower portion and the movable jaw load receiving section.

According to the above structure, instead of the toggle plate conventionally used, which has a sandwiching structure, the swingable coupling joint, which never comes off and falls, is used for the connecting member for the lower end portion of the movable jaw which receives load during compression crushing of the jaw crusher and the movable jaw load receiving section attached to the frame. Consequently, since the attached spring is not needed, the structure is simplified, and the tip clearance adjusting time can be shortened. Further, the lubrication at the connecting portion is secured, and the frequency of maintenance is reduced with less abrasion, thus improving operation efficiency.

Further, in the jaw crusher, the movable jaw load receiving section may have a structure forming a rotatable link mechanism including a hydraulic cylinder with a close fit mechanism.

According to the above structure, relative movement in the axial direction is locked by friction of the hydraulic cylinder with the close fit mechanism, and therefore the friction part slides when an abnormally large force is applied, thus preventing damage of the connecting portion (coupling joint) of the lower portion of the movable jaw and the movable jaw load receiving section, the rotary link mechanism, the frame and the like. The prior art crushers have the structure in which damaging of the connecting portion (toggle plate) prevents the damage to the other members. Since the length of the hydraulic cylinder with the close fix mechanism can be changed with hydraulic pressure, the adjustment of the clearance between the stationary jaw and the movable jaw is facilitated, and thus operability is improved. Further, since the friction of the hydraulic cylinder with the close fit mechanism locks the movement in the rod shaft direction, the load from the movable jaw is surely set, thus making the optimal strength design possible.

Further, in the jaw crusher, the structure including a hydraulic circuit which makes the hydraulic cylinder with the close fit mechanism open at a time of crushing operation may be made.

According to the above structure, since the hydraulic cylinder with the close fit mechanism is made open at a time of crushing operation, greater economy is obtained with no energy loss, and an accumulator for holding oil pressure for the hydraulic circuit, a leakage prevention valve and the like are made unnecessary, thus simplifying the circuit.

A second aspect of the jaw crusher according to the present invention has the structure including a stationary jaw fixedly provided at a frame, a movable jaw which is provided to oppose the stationary jaw and attached swingably with an eccentric drive shaft, a movable jaw load receiving section attached to the frame, and a connecting member for connecting a lower portion of the movable jaw and the movable jaw load receiving section, wherein the movable jaw load receiving section forms a rotatable link mechanism including a hydraulic cylinder with a close fit mechanism, and the jaw crusher has the structure further including a hydraulic circuit which makes the hydraulic cylinder with the close fit mechanism open at a time of a crushing operation.

According to the above structure, relative movement in the axial direction is locked by friction of the hydraulic cylinder with the close fit mechanism, and therefore when an abnormally large force is applied, the close fit part slides and prevents the damage of the connecting portion, the rotary link mechanism, the frame and the like. Since the length of the hydraulic cylinder with the close fit mechanism can be changed by hydraulic pressure, adjustment of the clearance between the stationary jaw and the movable jaw can be facilitated, thus improving operability. Further, since the relative movement in the axial direction is locked by the friction of the hydraulic cylinder with the close fit mechanism, setting of the load from the movable jaw is surely made, and therefore optimal strength design can be made. Further, at the time of a crushing operation, the hydraulic cylinder with the close fit mechanism is made open, greater economy is obtained with no energy loss, and an accumulator for holding oil pressure in the hydraulic circuit, the leakage prevention valve and the like become unnecessary, thus simplifying the circuit.

Further, in the jaw crusher, the hydraulic cylinder with the close fit mechanism may have the structure having the close fit mechanism of the piston and the cylinder.

According to the above structure, the hydraulic cylinder with the close fit mechanism has the close fit mechanism of the piston and the cylinder, the relative movement in the axial direction is locked with the frictional force by the close fitting and the length in the axial direction is made changeable by hydraulic pressure applied to both end portions of the piston. As a result, a large locking force can be obtained with a small size and the total length can be reduced, thus making it possible to reduce the apparatus in size.

A third aspect of the jaw crusher according to the present invention has the structure including a stationary jaw fixedly provided at a frame, a movable jaw which is provided to oppose the stationary jaw and attached swingably with an eccentric drive shaft, a movable jaw load receiving section attached to the frame, and a connecting member for connecting a lower portion of the movable jaw and the movable jaw load receiving section, wherein the movable jaw load receiving section forms a rotatable link mechanism including a hydraulic cylinder with a close fit mechanism, and wherein the hydraulic cylinder with the close fit mechanism has a close fit mechanism of a piston and a cylinder.

According to the above structure, the relative movement in the axial direction is locked by friction of the hydraulic cylinder with the close fit mechanism, and therefore when an abnormally large force is applied, the close fit part slides and prevents damage of the connecting portion, the rotary link mechanism, the frame and the like. Further, since the length of the hydraulic cylinder with the close fit mechanism can be changed with hydraulic pressure, the adjustment of the clearance between the stationary jaw and the movable jaw can be facilitated, thus improving operability. Furthermore, since the movement in the axial direction is locked by the friction of the hydraulic cylinder with the close fit mechanism, setting of the load from the movable jaw is surely made, and therefore optimal strength design can be made. Further, the hydraulic cylinder with the close fit mechanism has the close fit mechanism of the piston and the cylinder, locks the relative movement in the axial direction with the friction force by the close fitting, and makes the length in the axial direction changeable by the hydraulic pressure applied to both end portions of the piston, thus making it possible to obtain a large locking force with a small size, reduce the total length, and make the apparatus compact.

Further, in the jaw crusher, the structure in which one end portion of the hydraulic cylinder with the close fit mechanism is attached to the frame near the eccentric drive shaft may be made.

According to the above structure, one end portion of the hydraulic cylinder with the close fit mechanism is attached to the frame near the eccentric drive shaft having rigidity, and therefore special reinforcement of the frame for attachment of the hydraulic cylinder becomes unnecessary, thus making it possible to reduce in weight. Further, placement in the substantially vertical direction is made possible, whereby the total length of the jaw crusher can be reduced, the frame can be reduced in weight, and the jaw crusher can be easily mounted on a vehicle.

BEST MODE FOR CARRYING OUT THE INVENTION

Preferred embodiments of a jaw crusher according to the present invention will be explained in detail below with reference to the drawings.

At first, a first embodiment will be explained based on FIG. 1 to FIG. 6.

Figure 1:
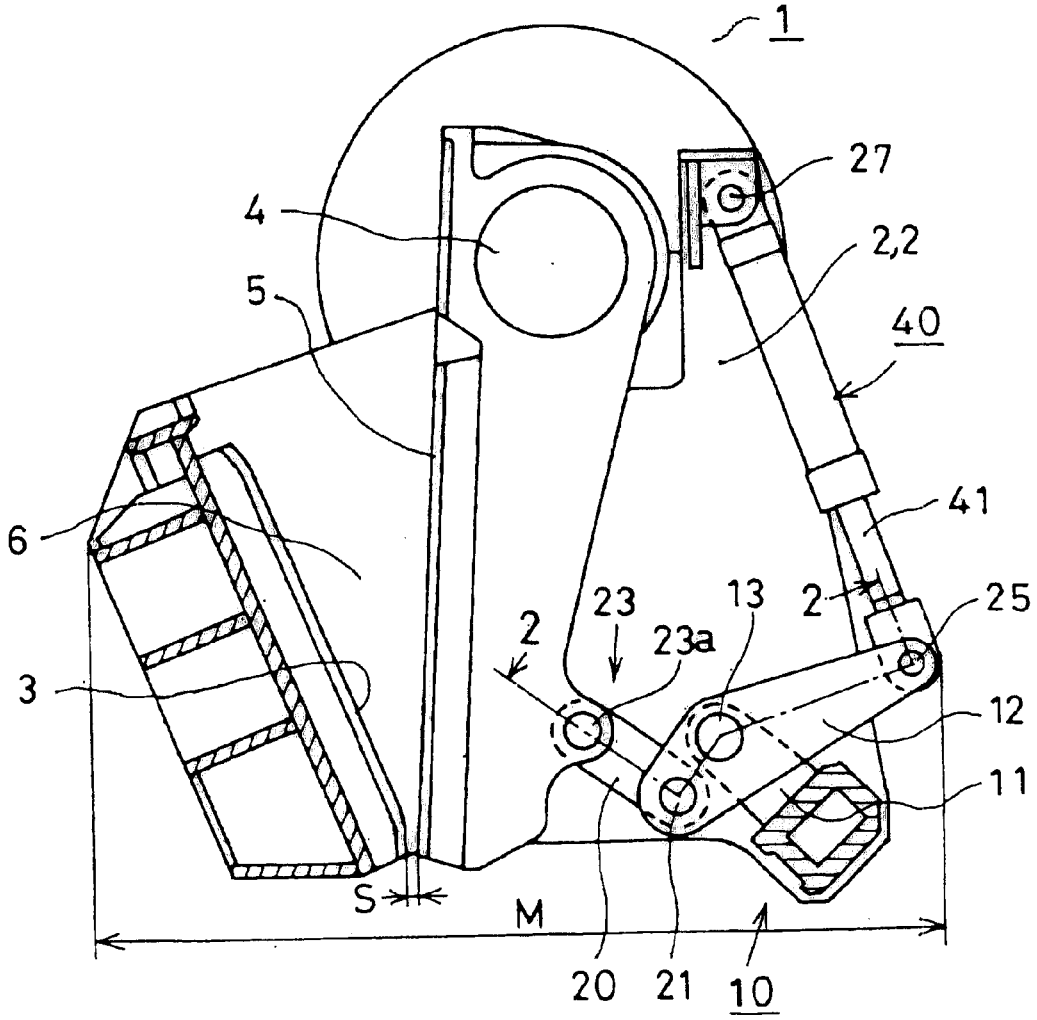
FIG. 1 is a partial sectional side view of a jaw crusher according to a first embodiment of the present invention.

FIG. 1 is a partial sectional side view showing an example of a jaw crusher 1. In FIG. 1, a stationary jaw 3 is attached between a pair of left and right frames 2 and 2, and a movable jaw 5 is swingably suspended at an eccentric drive shaft 4 provided at frames 2 and 2 at a position opposing the stationary jaw 3, whereby a crushing chamber 6 is formed between the stationary jaw 3 and the movable jaw 5. A movable jaw load receiving section 10 forming a link mechanism is provided at a back of the movable jaw 5 between the frames 2 and 2. Namely, a longitudinal middle portion of a lever 12 is swingably attached to a bracket 11 fixedly provided at the frames 2 and 2 by means of a first pin 13.

One end portion of a link 20 is attached to one end portion of the lever 12 by means of a second pin 21 as an example of a pin coupling joint, and the other end portion of the link 20 is rotatably connected to a lower portion of the back side of the movable jaw 5 by means of a third pin 23*a* as an example of the pin coupling joint. The link 20, the second pin 21 and the third pin 23*a* form a coupling joint 23 for swingably connecting the lower portion of the movable jaw 5 and the movable jaw load receiving section 10. The other end portion of the lever 12 is rotatably connected to a tip end portion of a piston rod 41 of a hydraulic cylinder 40 with a close fit mechanism by means of a fourth pin 25. The hydraulic cylinder 40 with the close fit mechanism is placed with its cylinder shaft being faced in substantially a vertical direction, and its base end portion is rotatably attached to an upper portion of the frame 2 by means of a fifth pin 27.

A reaction force occurring when an object to be crushed is crushed in the crushing chamber 6 is transmitted to the hydraulic cylinder 40 with the close fit mechanism via the link 20 and the lever 12. The lever 12, the hydraulic cylinder 40 with the close fit mechanism, the bracket 11 and each of the connecting pins 13, 25 and 27 form the movable jaw load receiving section 10. The eccentric drive shaft 4, the movable jaw load receiving section 10 and the coupling joint 23 constitute a movable jaw holding mechanism for holding the movable jaw 5 at the frame 2. Here, the coupling joint 23 is an example of a connecting member for connecting the movable jaw 5 and the movable jaw load receiving section 10.

Figure 2:
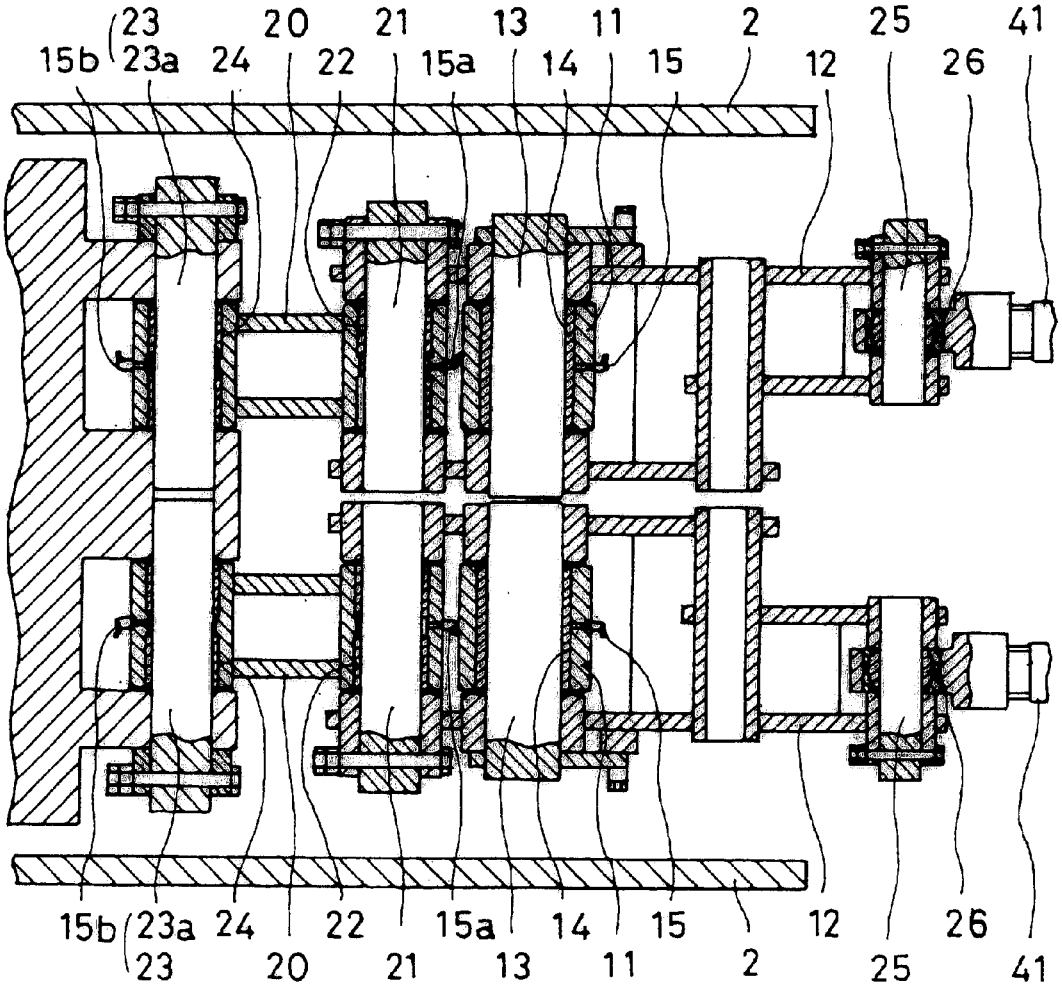
FIG. 2 is a sectional view taken along the line 2—2 in FIG. 1.

FIG. 2 is a sectional view taken along the line 2—2 in FIG. 1, an the detail of a connecting portion of the link 20 and the lever 12 will be explained with reference to FIG. 2. In FIG. 2, two of the aforementioned brackets 11, levers 12, links 20, and hydraulic cylinders 40 each with the close fit mechanism, having the same structure, are provided in parallel on the left and right (up and down in FIG. 2) of the movable jaw 5. A first bushing 14 is provided between the bracket 11 and the first pin 13, and lubricant oil is supplied to the first bushing 14 from a nipple 15. A second bushing 22 is provided between the one end portion of the link 20 and the second pin 21, and lubricant oil is supplied to the second bushing 22 from a nipple 15*a*. A third bushing 24 is provided between the other end portion of the link 20 and the third pin 23*a*, and lubricant oil is supplied to the third bushing 24 from a nipple 15*b*. A ball bearing 26 is provided at the forth pin 25 portion for connecting the other end portion of the lever 12 and the tip end portion of the piston rod 41 of the hydraulic cylinder 40 with the close fit mechanism.

Figure 3:
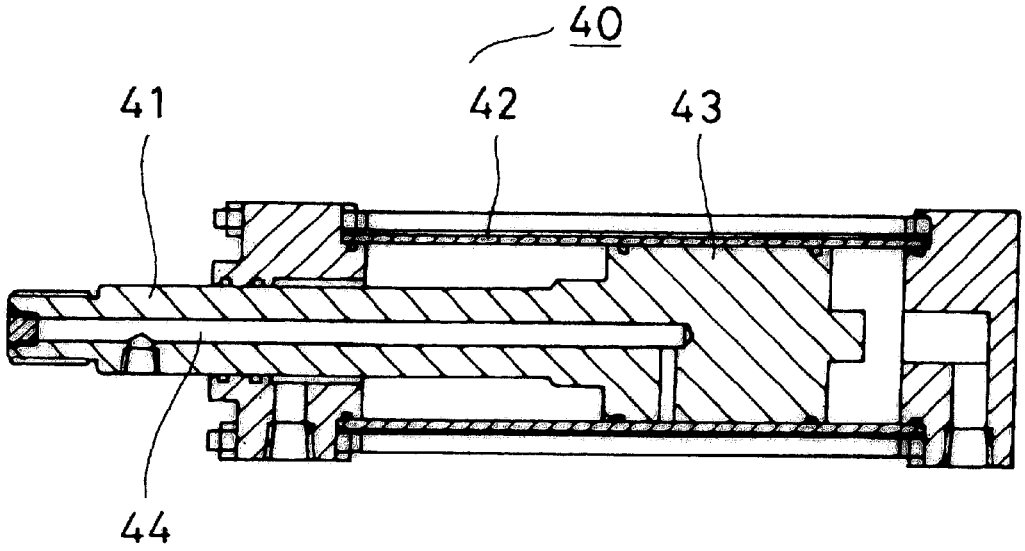
FIG. 3 is a side sectional view of a hydraulic cylinder with a close fit mechanism according to a first embodiment.
Figure 4:
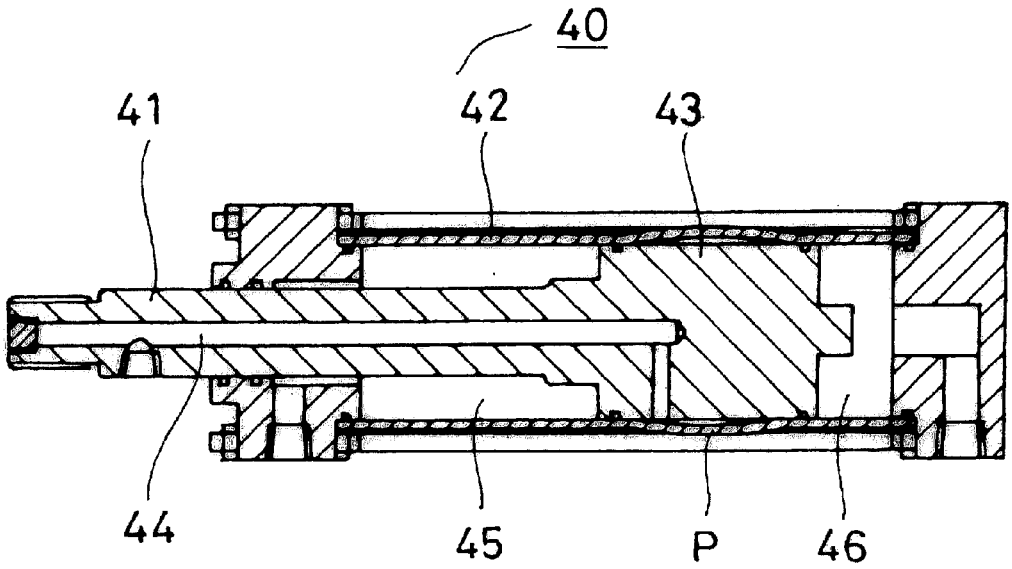
FIG. 4 is an explanatory view of an operation of a hydraulic cylinder with a close fit mechanism in FIG. 3.

Next, based on FIG. 3, a structure of the hydraulic cylinder 40 with the close fit mechanism will be explained. FIG. 3 is a sectional view of the hydraulic cylinder 40 with the close fit mechanism. A piston 43 having a piston rod 41 is pressed into a cylinder 42. An oil hole 44 is formed in the piston rod 41, and the oil hole 44 is communicated with an outside surface of the piston 43. FIG. 3 shows a state in which oil pressure is not supplied to the oil hole 44 from outside, and in this state, the piston 43 is in a fixed position with frictional resistance with the cylinder 42. When the hydraulic cylinder 40 with the close fit mechanism is contracted and extended, as shown in FIG. 4, pressure is supplied into the oil hole 44 so that the cylinder 42 area at the outer circumferential part of the piston 43 is expanded as a section P shown in FIG. 4 to expand the inner diameter. Thus, the frictional resistance between the piston 43 and the cylinder 42 is reduced, whereby the press fitting force of the piston 43 is reduced, and subsequently, the oil pressure oil is supplied to a cylinder head chamber 45 or a cylinder bottom chamber 46 to thereby move the piston 43.

Figure 5:
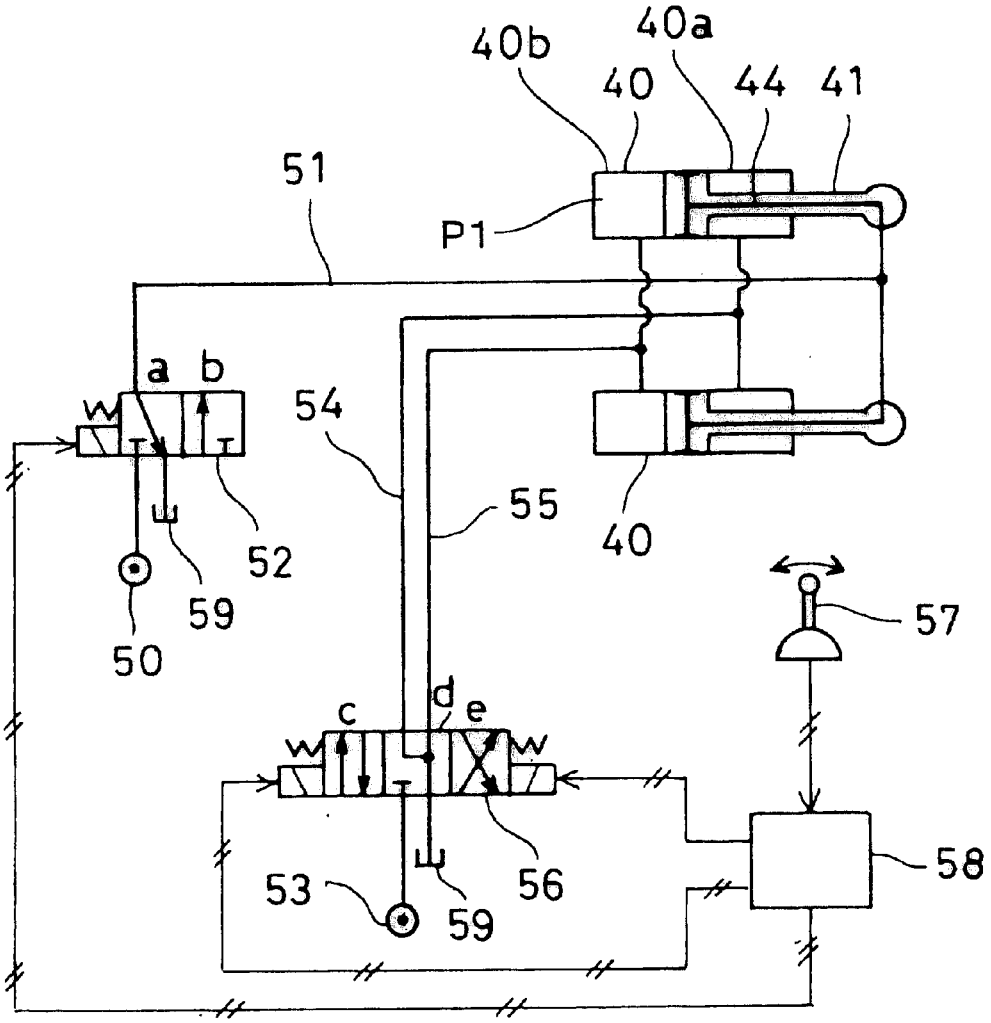
FIG. 5 is a hydraulic circuit diagram of a jaw crusher according to the first embodiment.

Next, the explanation will be made based on a hydraulic circuit diagram of the jaw crusher shown in FIG. 5. In FIG. 5, a first electromagnetic change-over valve 52 is provided on a piston circuit 51 for connecting the oil hole 44 of the piston rod 41 of the hydraulic cylinder 40 with the close fit mechanism and a first oil hydraulic source 50. A second electromagnetic change-over valve 56 is provided on a head circuit 54 and a bottom circuit 55 for connecting the cylinder head chamber 45 and the cylinder bottom chamber 46 of the hydraulic cylinder 40 with the close fit mechanism to a second oil hydraulic source 53.

The first electromagnetic changeover valve 52 has two positions a and b shown in FIG. 5, the piston circuit 51 is connected to a tank 59 at the position a, and the circuit 51 is connected to a discharge circuit of the first oil hydraulic source 50 at the position b. The second electromagnetic change-over valve 56 has three positions c, d and e shown in FIG. 5, the head circuit 54 is connected to the second oil hydraulic source 53 at the position c, the head circuit 54 and the bottom circuit 55 are connected to the tank 59 at the position d, and the bottom circuit 55 is connected to the second oil hydraulic source 53 at the position c. Further, an operation lever 57 for operating the hydraulic cylinder 40 with the close fit mechanism to contract and extend is provided, and an operation signal of the operation lever 57 is electrically connected to the first electromagnetic change-over valve 52 and the second electromagnetic change-over valve 56 via a controller 58.

Figure 6:
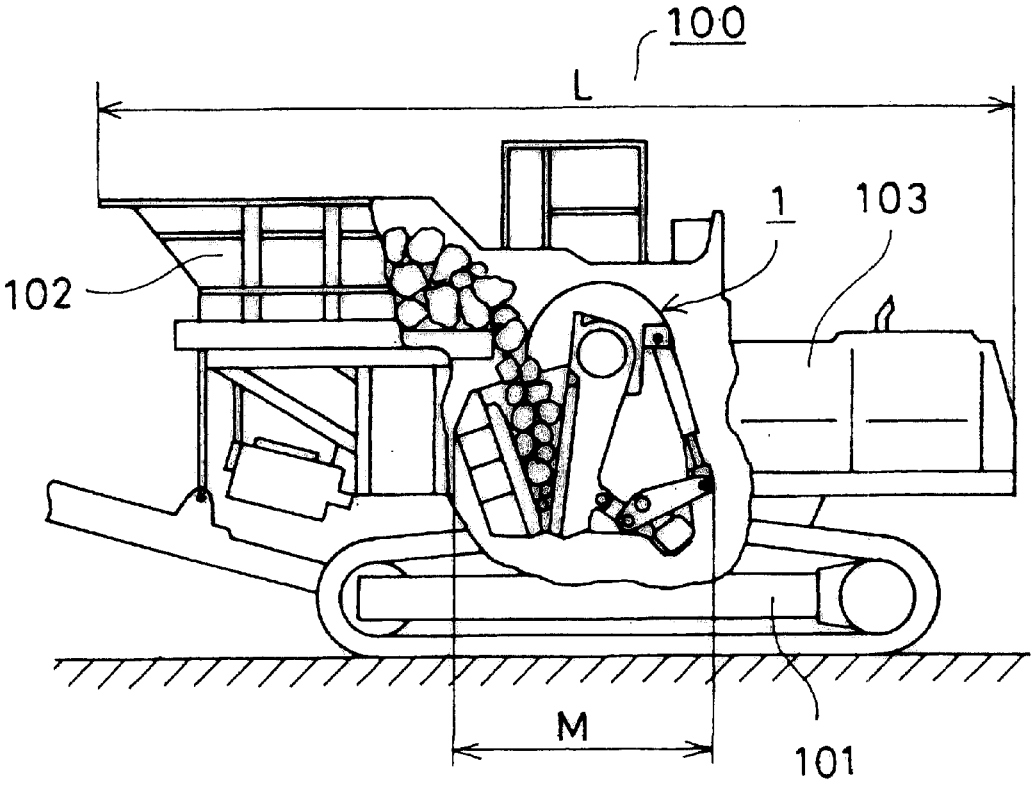
FIG. 6 is a partial sectional side view of a self-propelled jaw crusher mounted with the jaw crusher according to the first embodiment.
Figure 8:
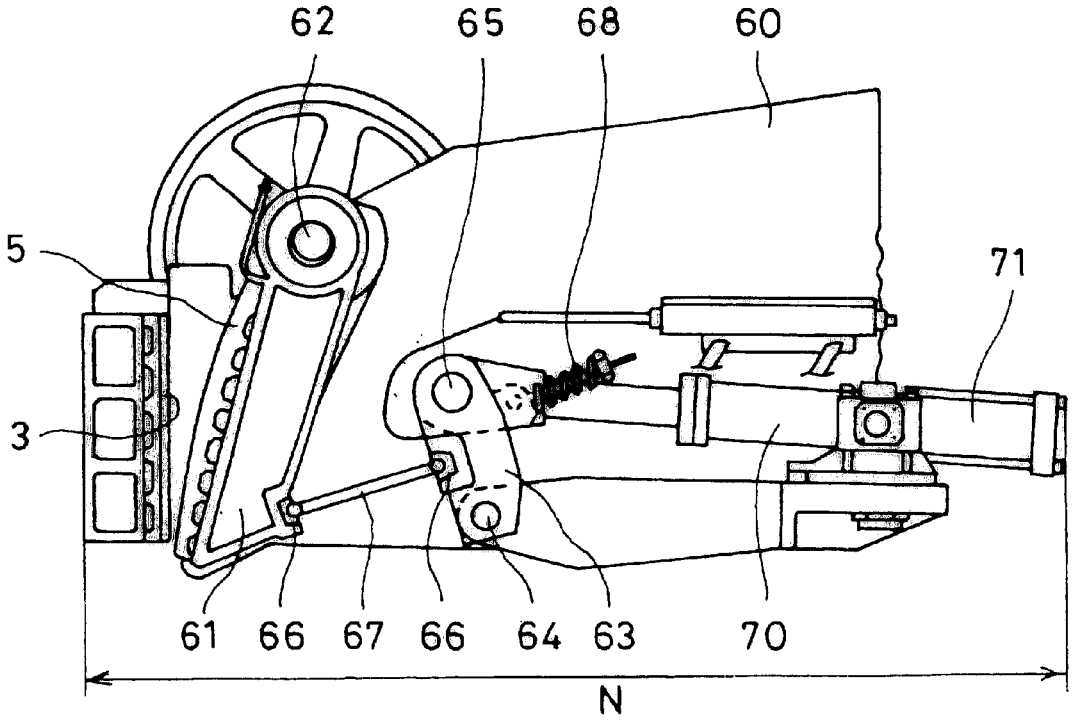
FIG. 8 Prior Art
FIG. 8 is an explanatory view in a side section of a jaw crusher of a first example of a prior art.
Figure 9:
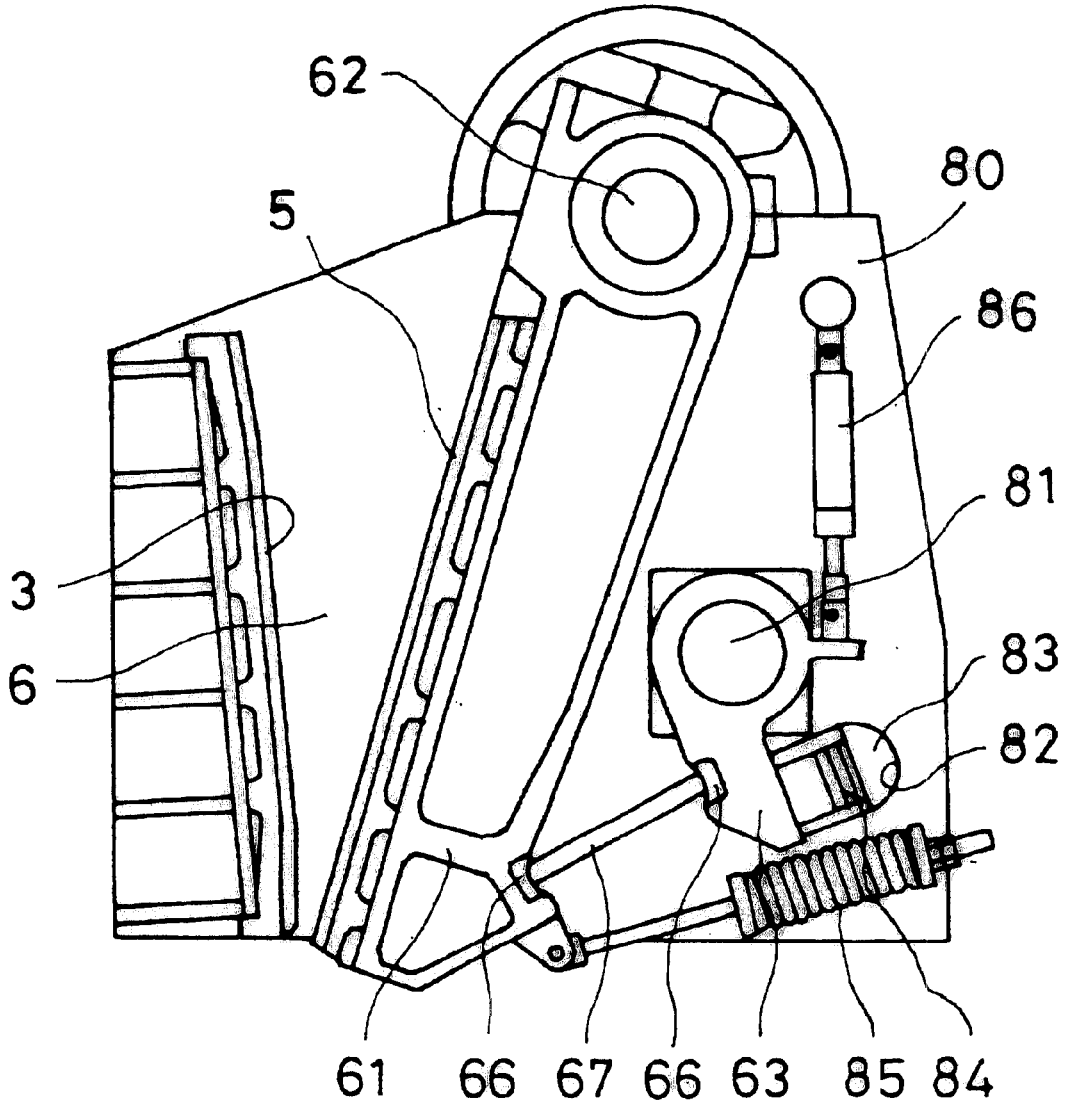
FIG. 9 Prior Art
FIG. 9 is an explanatory view in a side section of a jaw crusher of a second example of the prior art.

FIG. 6 is a partial sectional view of a self-propelled jaw crusher 100 of an example, on which the jaw crusher 1 of the first embodiment is mounted. In FIG. 6, the jaw crusher 1 is mounted on a top portion in the middle of a traveling unit 101, and a hopper 102 is mounted in front thereof, while a power source 103 is mounted behind it. Accordingly, a total length M of the jaw crusher 1 is shorter than the length N of the conventional one shown in FIG. 8 as described above, and therefore a total length L of the self-propelled jaw crusher 100 can be made shorter and compact.

Next, an operation of the jaw crusher 1 will be explained with reference to FIG. 1 to FIG. 5.

At the time of the start of a crushing operation, an operator operates the operation lever 57 shown in FIG. 5, so that the first electromagnetic change-over valve 52 is firstly switched into the position b to feed pressure oil into the oil hole 44 of the hydraulic cylinder 40 with the close fit mechanism to reduce the frictional force between the cylinder 42 and the piston 43. Next, the second electromagnetic change-over valve 56 is switched into the position c or the position c to apply predetermined pushing pressure P1 to the head chamber 40*a* or the bottom chamber 40*b* of the hydraulic cylinder 40 with the close fit mechanism to contract or extend the hydraulic cylinder 40 with the close fit mechanism. Subsequently, the movable jaw 5 is swung via the lever 12 and the coupling joint 23 to adjust an outlet clearance S at the tip end portion of the stationary jaw 3 and the movable jaw 5 shown in FIG. 1 in accordance with a product. Next, after the first electromagnetic change-over valve 52 is switched into the position a to fix the cylinder 42 and the piston 43 with the frictional force, the second electromagnetic change-over valve 56 is switched into the position d to connect the head circuit 54 and the bottom circuit 55 to the tank 59, and the head chamber 40*a* and the bottom chamber 40*b* of the hydraulic cylinder 40 with the close fit mechanism are opened to make the pushing pressure P1 zero. As described above, the movable jaw load receiving section 10 (the lever 12, the hydraulic cylinder 40 with the close fit mechanism, the bracket 11 and each of the connecting pins 13, 25 and 27) and the coupling joint 23 form a part of the clearance adjusting mechanism.

Thereafter, when the crushing operation is started, a crushing reaction force is applied to the movable jaw 5 shown in FIG. 1, and the reaction force is transmitted to the hydraulic cylinder 40 with the close fit mechanism via the link 20 and the lever 12. When foreign substances and the like enter the crushing chamber 6, the crushing reaction force becomes excessively large, and the force applied to the hydraulic cylinder 40 with the close fit mechanism exceeds the frictional force between the cylinder 42 and the piston 43, slip occurs between both of them, and the hydraulic cylinder 40 with the close fit mechanism is contracted to enlarge the outlet clearance S so that the foreign substances are discharged. Thus, the connecting portion of the movable jaw 5 and the load receiving section, the rotary link mechanism as the load receiving section, the frame 2 and the like are prevented from being damaged by excessive load. Thereafter, the operator adjusts the outlet clearance S again and restarts the operation.

Since the jaw crusher 1 according to the first embodiment of the present invention is constituted as described above, the following effects can be obtained.

The coupling joint 23, which connects the lower end portion of the movable jaw 5 that receives a load during compression crushing of the jaw crusher 1, and the movable jaw load receiving section 10 attached to the frame 2, is made a pin joint, which is not detached and does not fall off. This is an improvement over sandwiching structure used by the conventional toggle plate. As a result, the structure is simplified, and lubrication of the connecting portion can be surely made, whereby abrasion is reduced and thus the frequency of maintenance is reduced, thus improving operation efficiency. Since the relative movement in an axial direction is locked by the friction of the hydraulic cylinder 40 with the close fit mechanism, the close fit section of the hydraulic cylinder 40 with the close fit mechanism slides when an abnormally large load is exerted, and breakage of the connecting portion, the rotary link mechanism, the frame 2 and the like can be prevented.

Since the length of the hydraulic cylinder 40 with the close fit mechanism can be changed by hydraulic pressure, the outlet clearance S between the stationary jaw 3 and the movable jaw 5 can be easily adjusted, and operability is improved. Since the relative movement in the axial direction is locked by the friction of the hydraulic cylinder 40 with the close fit mechanism, an allowable value of the load received from the movable jaw 5 can be surely set, and thus optimum strength design can be made. The hydraulic cylinder 40 with the close fit mechanism includes the cylinder 42, the piston 43 and the piston rod 41, it locks the relative movement in the axial direction by the frictional force by the close fitting of the piston 43 and the cylinder 42, and it makes the axial length changeable by the hydraulic pressure applied to both end portions of the piston 43. As a result, large locking power can be obtained with the smaller size, and the total length can be reduced, thus reducing the apparatus in size and weight.

Since the oil pressure is not applied to the hydraulic cylinder 40 with the close fit mechanism during a crushing operation, greater economy is obtained with no energy loss, and an accumulator for holding the oil pressure, a leakage prevention valve and the like are not needed in the hydraulic circuit, whereby the circuit is simplified and the cost is reduced. Since the shaft of the hydraulic cylinder 40 with the close fit mechanism is placed in the substantially vertical direction, the total length M of the jaw crusher 1 can be reduced, whereby the frame 2 can be reduced in weight and the vehicle can be made compact when it is mounted thereon. Further, since the connecting portion (the fifth pin 27 portion) with the frame 2 is provided near the eccentric drive shaft 4 having rigidity, special rigidity reinforcement for the frame 2 is not needed and weight reduction can be realized.

In the above-described first embodiment, pin coupling (by the third pin 23*a* shown in the drawing) is used for the coupling joint 23 of the lower portion of the movable jaw 5 and the movable jaw load receiving section 10, but they may be connected with a trunnion joint, a universal joint, a joint with use of a ball bearing or the like. An example in which two of the brackets 11, the levers 12, the links 20 and the hydraulic cylinders 40 each with the close fit mechanism are provided in parallel is shown, but this is not restrictive, and they may be constituted by an integrated one or by each single unit of them. Further, the piston rod 41 of the hydraulic cylinder 40 with the close fit mechanism may be attached in the opposite direction. Furthermore, the number of links of the movable jaw load receiving section 10 forming the link mechanism is not limited to the above-described embodiment.

Figure 7:
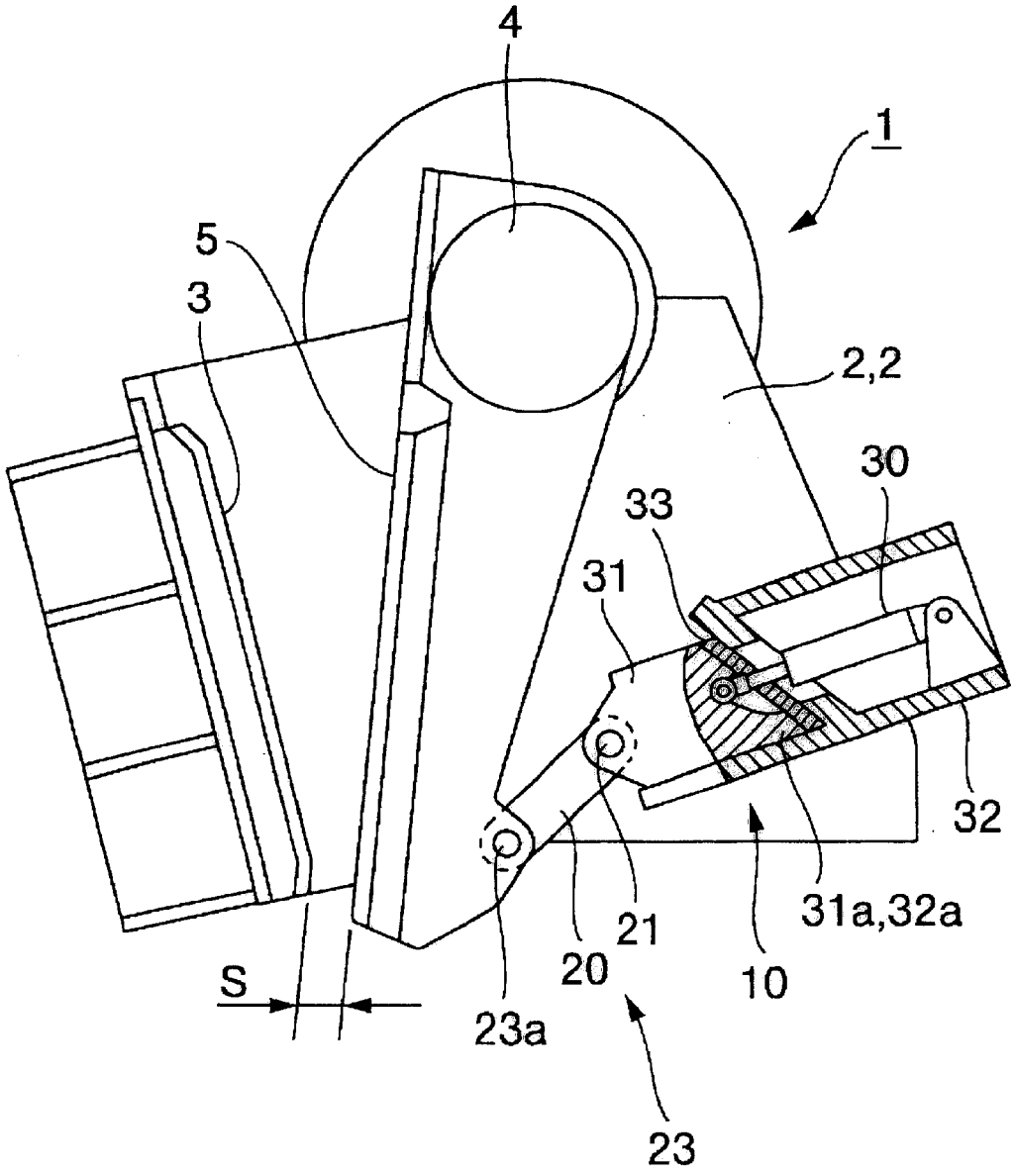
FIG. 7 is a partial sectional side view of a jaw crusher according to a second embodiment of the present invention.

Next, a second embodiment will be explained with reference to FIG. 7. A stationary jaw 3 is attached to a pair of left and right frames 2 and 2, and a movable jaw 5 is suspended to be swingable by an eccentric drive shaft 4 provided at the frames 2 and 2. A lower portion of the movable jaw 5 and a movable jaw load receiving section 10 are swingably connected by a coupling joint 23 as an example of a connecting member for connecting both components, which is constituted by a link 20 and pins 21 and 23*a*. In the second embodiment, the movable jaw load receiving section 10 includes a toggle block 31, a hydraulic cylinder 30, a pedestal 32 and a shim 33. The toggle block 31 is slidably mounted on the pedestal 32, and includes, at the side of the pedestal 32, a protruded part 31*a* (as shown in FIG. 7, the protruded part with a V-shaped section) with a top surface being a downward inclined plane toward the direction away from the movable jaw 5, as shown in FIG. 7.

The pedestal 32 has, at the side of the toggle block 31, a V-shaped opening 32*a* which has the shape conforming to the protruded part 31*a* and is capable of being in contact with the protruded part 31*a*. The pedestal 32 has the shim 33, which can be freely taken in and out, between the downward inclined plane of the toggle block 31 and the pedestal 32. Both end portions of left and right hydraulic cylinders 30 and 30 in a plan view are connected with pins between the toggle block 31 and the pedestal 32. Either one of the front and rear pin connection parts of the hydraulic cylinders 30 and 30 is connected with a horizontal pin as shown in FIG. 7 (in FIG. 7, the pin connection part at the side of the pedestal 32), so that the hydraulic cylinder 30 can smoothly swing in a vertical direction at the time of adjusting the outlet clearance (tip clearance) S between the stationary jaw 3 and the movable jaw 5 and at the time of operating the jaw crusher 1. The movable jaw 5 is held by the frame 2 by the eccentric drive shaft 4, the movable jaw load receiving section 10 and the coupling joint 23 (an example of the connecting member).

An operation according to the above-described structure will be explained. When the jaw crusher 1 is operated, the lower portion of the movable jaw 5 makes swing movement with the pin 21 as a center via the link 20 to crush an object to be crushed between the movable jaw 5 and the stationary jaw 3. The load of the movable jaw 5 during crushing is received by the movable jaw load receiving section 10 constituted by the toggle block 31, the pedestal 32 and the like via the coupling joint 23. Under excessive load, for example, the link 20 is easily bent to absorb the excessive load. Consequently, the structure, which facilitates the replacement of the link 20, is made. The coupling joint 23 connects the movable jaw 5 and the movable jaw load receiving section 10 to be swingable with a pin, and therefore the lower portion of the movable jaw 5 smoothly swings.

The tip clearance adjusting mechanism in the second embodiment is as follows. Specifically, at the time of adjusting the tip clearance S, the lower portion of the movable jaw 5 is moved via the coupling joint 23 by contraction and extension of the hydraulic cylinder 30, and when the adjustment is completed, the shim 33 is inserted into a clearance between the downward inclined plane of the toggle block 31 and the pedestal 32. An external force in a direction to press the hydraulic cylinder 30 during crushing is received by the pedestal 32 via the link 20, the toggle block 31 and the shim 33, and therefore only the oil pressure which overcomes the external force in a direction to pull the hydraulic cylinder 30 (usually, smaller than the external force in the aforementioned pressing direction) may be applied.

According to the second embodiment, the following effect can be obtained. Since the lower portion of the movable jaw 5 and the movable jaw load receiving section 10 are swingably connected by the coupling joint 23 such as pin connection, a spring for holding and contacting the toggle plate as in the prior art is made unnecessary. As a result, abrasion of the connecting portion between the movable jaw 5 and the movable jaw load receiving section 10 is reduced, which improves durability and maintainability to improve operation efficiency, and adjustment of the spring after the tip clearance adjustment is made unnecessary, thus making it possible to reduce the adjusting time.

At the time of adjusting the tip clearance, the hydraulic cylinder 30 moves the heavy toggle block 31 and movable jaw 5, and therefore the adjusting operation can be easily performed, thus making it possible to reduce the adjusting time. Further, since the oil pressure applied to the hydraulic cylinder 30 during crushing is small, only small energy consumption of the oil pressure is needed. It may be suitable to stop the oil pressure applied to the hydraulic cylinder 30, and fix the contraction and extension of the cylinder 30 with a bolt or the like. In this case, the number of man-hours is increased a little due to attachment and detachment of the bolt or the like, but energy consumption of the oil pressure is eliminated.

As explained thus far, according to the present invention, the following effect is provided. As the connecting member for connecting the lower portion of the movable jaw and the movable jaw load receiving section, the coupling joint for connecting the both components swingably with a pin or the like is used, and therefore the abrasion of the connecting portion is decreased, thus making it possible to reduce the frequency of maintenance and improve the operation efficiency of the jaw crusher. The spring mechanism for preventing the connection member from being detached is unnecessary, and therefore the spring adjustment after the jaw tip clearance adjustment is unnecessary, thus making it possible to reduce adjusting time and improve the operation efficiency.

Since the jaw tip clearance is adjusted by swinging the movable jaw with the hydraulic cylinder, the adjustment operation can be carried out with ease and facilitated, and therefore adjusting time can be reduced. Since the oil pressure applied to the hydraulic cylinder during the crushing operation may be zero (in the case of the hydraulic cylinder with the close fit mechanism), or may be small (in the case of combination of the pedestal, toggle block and the hydraulic cylinder), energy loss of the oil pressure can be reduced.

According to the structure in which the movable jaw load receiving section includes the hydraulic cylinder with the close fit mechanism, the close fit friction part of the hydraulic cylinder with the close fit mechanism can slide under excessive load and absorb the excessive load, the breakage of the frame, movable jaw, the connecting member and the like can be prevented. The movement of the piston is locked with friction caused by the close fit mechanism of the piston and the cylinder, and therefore the hydraulic cylinder with the close fit mechanism can be reduced in size. Further, since one end portion of the hydraulic cylinder with the close fit mechanism is attached to the frame near the eccentric drive shaft with rigidity, the frame can be reduced in weight and can be placed in the substantially vertical direction, whereby the total length of the jaw crusher can be reduced, the frame can be reduced in weight and the jaw crusher can be easily mounted on a vehicle.

What is claimed is:

1. A jaw crusher, comprising:

a stationary jaw fixedly attached to a frame;

a movable jaw which is arranged to oppose said stationary jaw and attached swingably to an eccentric drive shaft;

a movable jaw load receiving section attached to said frame; and a connecting member that swingably connects a lower portion of said movable jaw and said movable jaw load receiving section, said connecting member being connected by respective pin coupling joints to said lower portion of said movable jaw and said movable jaw load receiving section.

2. The jaw crusher according to claim 1, wherein said movable jaw load receiving section comprises a lever pivotally connected to said connecting member and a hydraulic cylinder with a close fit mechanism pivotally connected to said lever, said lever being rotatably mounted to said frame.

3. The jaw crusher according to claim 2, further comprising:

a hydraulic circuit which makes said hydraulic cylinder with the close fit mechanism open during a crushing operation so that oil pressure is not maintained in the hydraulic cylinder during the crushing operation.

4. A jaw crusher, comprising:

a stationary jaw fixedly attached to a frame;

a movable jaw which is arranged to oppose said stationary jaw and attached swingably to an eccentric drive shaft;

a movable jaw load receiving section attached to said frame; and a connecting member for connecting a lower portion of said movable jaw and said movable jaw load receiving section, wherein said movable jaw load receiving section comprises a rotatable link mechanism including a hydraulic cylinder with a close fit mechanism, said jaw crusher further comprising a hydraulic circuit which makes said hydraulic cylinder with the close fit mechanism open during a crushing operation so that oil pressure is not maintained in the hydraulic cylinder during the crushing operation and a position of said hydraulic cylinder is maintained by frictional resistance of the close fit mechanism during the crushing operation.

5. The jaw crusher according to claim 4, wherein said close fit mechanism comprises a piston and that fits closely within a cylinder and is held against movement therein by frictional resistance.

6. A jaw crusher, comprising:

a stationary jaw fixedly attached to a frame;

a movable jaw which is arranged to oppose said stationary jaw and attached swingably to with an eccentric drive shaft;

a movable jaw load receiving section attached to said frame; and a connecting member for connecting a lower portion of said movable jaw and said movable jaw load receiving section, wherein said movable jaw load receiving section comprises a rotatable link mechanism including a hydraulic cylinder with a close fit mechanism, and wherein said close fit mechanism comprises a piston that fits closely within a cylinder and is held against movement therein by frictional resistance, and a means for reducing said frictional resistance to allow said piston to be moved within said cylinder for adjusting an outlet clearance between the stationary jaw and the movable jaw.

7. The jaw crusher according to any one of claim 2 to claim 6, wherein one end portion of said hydraulic cylinder with the close fit mechanism is attached to said frame near said eccentric drive shaft.

* * * * *